United States Patent [19]

Tapio et al.

[11] 4,192,711

[45] Mar. 11, 1980

[54] PAPER-MANUFACTURING METHOD AND APPARATUS FOR CONVEYING A WEB FROM A FORMING WIRE TO A DRYING SECTION

[75] Inventors: Olli Tapio; Lassi Veijonen; Eero Hannonen, all of Jyväskylä, Finland

[73] Assignee: Valmetoy, Finland

[21] Appl. No.: 853,538

[22] Filed: Nov. 21, 1977

[30] Foreign Application Priority Data

Nov. 30, 1976 [FI] Finland ..... 763434

[51] Int. Cl.[2] ..... D21F 3/02; D21F 3/04

[52] U.S. Cl. ..... 162/199; 162/206; 162/272; 162/305; 162/359; 162/360 R

[58] Field of Search ..... 162/199, 206, 207, 272, 162/290, 305, 306, 359, 360 R, 361

[56] References Cited

U.S. PATENT DOCUMENTS

| | | | |
|---|---|---|---|
| 3,309,263 | 3/1967 | Grobe | 162/306 |
| 3,441,476 | 4/1969 | Schiel | 162/306 |
| 3,560,333 | 2/1971 | Douglas et al. | 162/206 |
| 4,016,032 | 4/1977 | Kankaanpaa | 162/305 |
| 4,056,433 | 11/1977 | Koponen et al. | 162/290 |
| 4,075,056 | 2/1978 | Ely et al. | 162/305 |

*Primary Examiner*—Richard V. Fisher

*Attorney, Agent, or Firm*—Steinberg and Blake

[57] ABSTRACT

A paper-manufacturing machine and method include the feature of detaching a web from a forming wire by utilizing a stationary transfer suction box past which a felt travels while contacting the web so that the latter becomes detached from the forming wire and adheres to the felt while travelling with the latter beyond the forming wire. The felt and web are lapped through a substantial angle around a roll having a recessed surface whiletravelling toward the first press nip of a press section, and at this roll around which the felt and web are lapped a means is provided for directing steam toward the web and through the latter and the felt inwardly toward the recessed surface of the guide roll so that the flowing steam will on the one hand heat water carried by the web to enhance dewatering of the web at the first press nip while on the other hand the steam will serve to maintain the web reliably in engagement with the felt as the latter travels toward the first press nip. Beyond the first press nip the web may be subjected to one or more additional press nips and, if desired, to the smoothing action of a smooth-surfaced roll which presses the web against a central smooth-surfaced roll of the press section, before the web is guided away from the central press roll to a drying section.

17 Claims, 3 Drawing Figures

PAPER-MANUFACTURING METHOD AND APPARATUS FOR CONVEYING A WEB FROM A FORMING WIRE TO A DRYING SECTION

BACKGROUND OF THE INVENTION

The present invention relates to a paper-manufacturing method and apparatus for conveying a web from a forming wire to a drying section of a paper machine.

Thus, the present invention is concerned with the wet end of a paper machine and in particular with a method and apparatus for detaching the web from a forming wire while transporting the web to a press section and beyond the latter to a drying section, and while carrying out dewatering of the web as it travels toward the drying section.

The detaching of the web formed in the wire section of a paper machine and its transfer to the press section is an extremely important step inasmuch as this particular step has a great influence on the reliable continued operation of a paper machine. With paper machines which operate at relatively low speeds it is possible to provide for open draws where there is an open conduction of an unsupported web, based on a speed differential between the wire and press sections. Such operations are known in connection with paper machines which operate at low speeds.

In paper machines which operate at high speeds or which manufacture thin, low-strength types of paper, it is known to utilize transfer systems which will protect the web, and the present invention relates to systems of this type. Such systems usually operate in such a way that a transfer felt of the press section is guided so as to contact the web at the location where it is to be detached from the wire. By way of the expedient of pressing, with a suitable rotating roll, the transfer felt against the web, the web is caused to adhere to the transfer felt which then transports the web away from the forming wire to the first nip of the press section.

In general there are two main types of closed transfer or carry-over systems. The simplest is the so-called "lick-up transfer", based on the ability of a wet "lick-up" felt to adhere the paper web to its surface. The other type of system is a "vacuum pick-up" system developed from the first system. By utilizing suction at the transfer location it is possible to adhere the web to the transfer felt with greater reliability. The vacuum pick-up system affords greater possibilities, as compared with the first system, for example with respect to selection of felt quality. Particularly in those cases where the transfer felt also operates as a press felt several requirements are imposed on the transfer felt. Thus the web must adhere reliably thereto particularly at the location where the web is detached from the wire, but on the other hand the felt must operate efficiently at the dewatering nip.

Conventional vacuum pick-up systems employ a suction roll and have been widely used. Such systems are encumbered, however, by certain drawbacks referred to below.

Thus, the suction roll utilized for reliably detaching the web from the wire and adhereing the web to the transfer felt has a perforated shell which may cause marking of the web, so as to detract from the appearance of the paper as well as possibly affecting its surface characteristics undesirably. Moreover, such suction rolls are extremely expensive. They require their own driving motor with their own control system, and they create an undesirable noise. Such suction rolls also have the drawback of consuming a large amount of air, because the suction system draws in through the perforations of the suction roll not only air which passes through the web and felt but also air arriving at the suction zone and entrained in the holes of the suction roll shell at every revolution thereof. Furthermore, various difficulties are created by the sealing water of the suction box which is situated in the interior of the suction roll.

In a conventional Fourdrinier machine, detachment of the web from the wire takes place at a location situated on a run of the wire between the couch roll and the traction roll. At this location the web travels together with the wire in a downward direction at an inclination which is on the order of 45° with respect to a horizontal plane. The detaching location is determined by the normal structure of the wire section and press section and by their location with respect to each other. Subsequent to the detaching location the pick-up felt and the web attached thereto lap the pick-up roll through an angle on the order of 70°–90°, and the pick-up felt with the web adhering thereto travel on to the press section.

Under certain circumstances (high speeds, inappropriate felt) the change in direction caused by the above lapping of the pick-up roll creates a tendency for the web to become separated from the pick-up felt as a result of the effect of centrifugal force. In order to prevent such separation of the web from the pick-up felt, the latter must be provided with a suction zone which is relatively extensive inasmuch as it must extend substantially beyond the detaching zone proper. In this way it is possible to make certain that the web adheres to the felt, but this requirement also creates an undesirably large additional load on the suction system of the pick-up roll. As a result the suction roll requires an undesirably great suction capacity, far beyond what is required simply for bringing about detachment of the web from the wire and attachment of the web to the felt.

Because of the above factors it has become known also in certain cases to utilize a stationary transfer suction box instead of the suction roll, and by the use of such a stationary transfer suction box it is possible to avoid some of the above drawbacks.

With respect to the state of the art pertaining to the present invention reference may be made to U.S. Pat. Nos. 3,441,476, 3,528,881, and 3,537,955.

As is well known, suction rolls are made with a rotating, perforated shell cylinder the inner surface of which is slidably engaged in a fluid-tight manner by a stationary suction box which extends axially along the interior of the shell from one end to the other thereof and which has a breadth on the order of, for example, 100–150 mm. The suction box is connected to the suction system in such a way that an air flow is achieved through holes which pass through the shell of the suction roll, the suction being created at that area of the shell which at any given instant extends across the suction box which has a sealed engagement with the inner surface of the shell. Such suction rolls are of course expensive. The drilling thereof, in particular, is difficult to carry out and involves high costs. The perforations made by drilling through the shell detract from the strength thereof, so that special metal alloys must be used, and in addition a considerable shell thickness is essential, all of which necessitates high material costs.

The air which is entrained in the holes of the suction roll shell and thereby carried into the suction zone and into the suction system has proved to be of an unexpectedly great quantity in modern, fast-running paper machines. The extent of this "hole air" increases progressively with increasing paper machine speed. The magnitude of the amount of "hole air" is even further increased by the fact that as the machine speed increases the suction rolls must be made of greater strength, and this is accomplished by increasing the thickness of the shell so that the quantity of hole air becomes proportional to the shell thickness.

A particularly serious drawback with respect to such suction rolls is that as they rotate they generate sharp disturbing noise which creates a serious health detriment to the workers in the vicinity of the machine. The generation of this noise results from the fact that the holes in the suction roll act as whistles. As these holes which are under vacuum arrive at the region just beyond the suction zone they are abruptly filled with air, giving rise to a powerful whistling sound which has a fundamental frequency equal to the acoustical resonance frequency of the hole. The set of whistling pipes constituted by the numerous holes of the suction roll often cause a noise surpassing the pain threshold of the human ear. While there have been previous attempts to suppress this noise by way of various arrangements, such as by using a more favorable drilling pattern, the fact is that in practice there has been no significant reduction in this undesirable noise.

In connection with press suction rolls, in particular, it is frequently necessary to provide for compensation for the deflection of the roll, but up to the present time this has not been possible because the hollow interior of the roll is already occupied by the suction box and therefore a deflection-compensating structure, which in itself is known, cannot be accommodated in the interior of such a suction roll.

One of the important operating characteristics which is highly desired in paper machines of the above type is the capability of achieving an effective dewatering action. It is a well-known physical fact that the viscosity of water diminishes considerably with increasing temperature. This factor has been utilized in attempts achieve a more efficient dewatering of the paper web in paper machines. Examples of previously known designs of this type may be seen in U.S. Pat. Nos. 2,907,690, 3,097,995, 3,560,333, and 3,655,507.

However, structures for enhancing the dewatering action by raising the temperature of the felt, web, and/or roll have not gained any extensive use, particularly with respect to fast-operating paper machines. This is partly because it is not possible by way of any known means to supply a great enough thermal energy flow to the points of supply. This latter factor results because the temperaure of treating gas is limited (for example with a view to preventing damage to the felt), the time available for heat transfer is extremely short owing to the high felt and web velocities, and the heat transfer area also is extremely restricted, as a result of space requirements.

SUMMARY OF THE INVENTION

It is accordingly a primary object of the present invention to provide a method and apparatus which will avoid the above drawbacks.

Thus, it is an object of the present invention to avoid the above drawbacks and to afford a suction transfer wherein kinetic energy and centrifugal force of the rotating and moving structural elements of the wire section and of the web itself are efficiently utilized in various way to bring about detachment of the web from the wire so that the use of suction energy for this purpose is minimized.

It is thus a primary object of the present invention to provide a method and apparatus in connection with the wet end of a paper machine according to which there is absolutely no requirement of suction rolls so that in this way important advantages are achieved.

A further object of the present invention is to provide a construction which will achieve a significant reduction in the noise created by the operation of the paper machine.

Furthermore it is an object of the present invention to provide suction rolls which do not require the interior space thereof to be occupied by suction boxes so that it is possible instead to situate in the interior of the suction rolls deflection-compensating structure.

Yet another object of the present invention is to provide a construction according to which it becomes possible to heat in an effective manner the web which is to be dewatered so as to enhance the dewatering action by raising the temperature of the water.

In accordance with the invention an endless felt means is guided by suitable guide rolls so as to contact a web which is on a forming wire at the location where the web is to be detached from the forming wire. The endless felt means is guided at the location where the web is to be detached from the forming wire past a transfer suction box which creates a suction which detaches the web from the forming wire and adheres the web to the endless felt means so as to travel therewith away from the forming wire. The endless felt means with the web adhering thereto is guided to the first press nip of a press section. In the path of travel of the endless felt means there is a guide roll having a recessed surface around which the endless felt means is lapped by a considerable angle together with the web adhering to the endless felt means with the latter situated between the web and the latter guide roll. At the place where the web and endless felt means lap the latter guide roll steam is applied to the web and the felt behind the same to travel therethrough toward the recess surface of the guide roll, thus heating the web so that dewatering thereof will be enhanced at the first press nip. In addition the steam acts on the web to urge the latter toward the endless felt means so as to reliably maintain the web adhered thereto. At the first press nip the web and endless felt means travel between a smooth-surfaced central press roll and a press roll which has a recessed surface where dewatering takes place. The web continues to travel beyond the endless felt means at the smooth surface of the central press roll so as to be further treated as by being subjected to further press nips.

By utilizing hot steam to raise the temperature of the web, this steam as it condenses releases its substantial latent heat (approximately 2270 kJ/kg) into the web. If furthermore the steam is supplied at the area according to the invention where the endless felt means and web lap the above guide roll by a considerable angle, the supply area of the steam is fairly large and it is possible to achieve in this way an immediate, efficient penetration of the web by the steam, as well as partly of penetration of the steam into the felt behind the web.

Thus, there is with the invention the advantage that at the location of supply of the steam, according to the invention, there is sufficient space available for an expedient steam supply means.

BRIEF DESCRIPTION OF THE DRAWINGS

The invention is illustrated by way of example in the accompanying drawings which form part of this application and in which.

DESCRIPTION OF PREFERRED EMBODIMENTS

Figures 1, 2, 3:
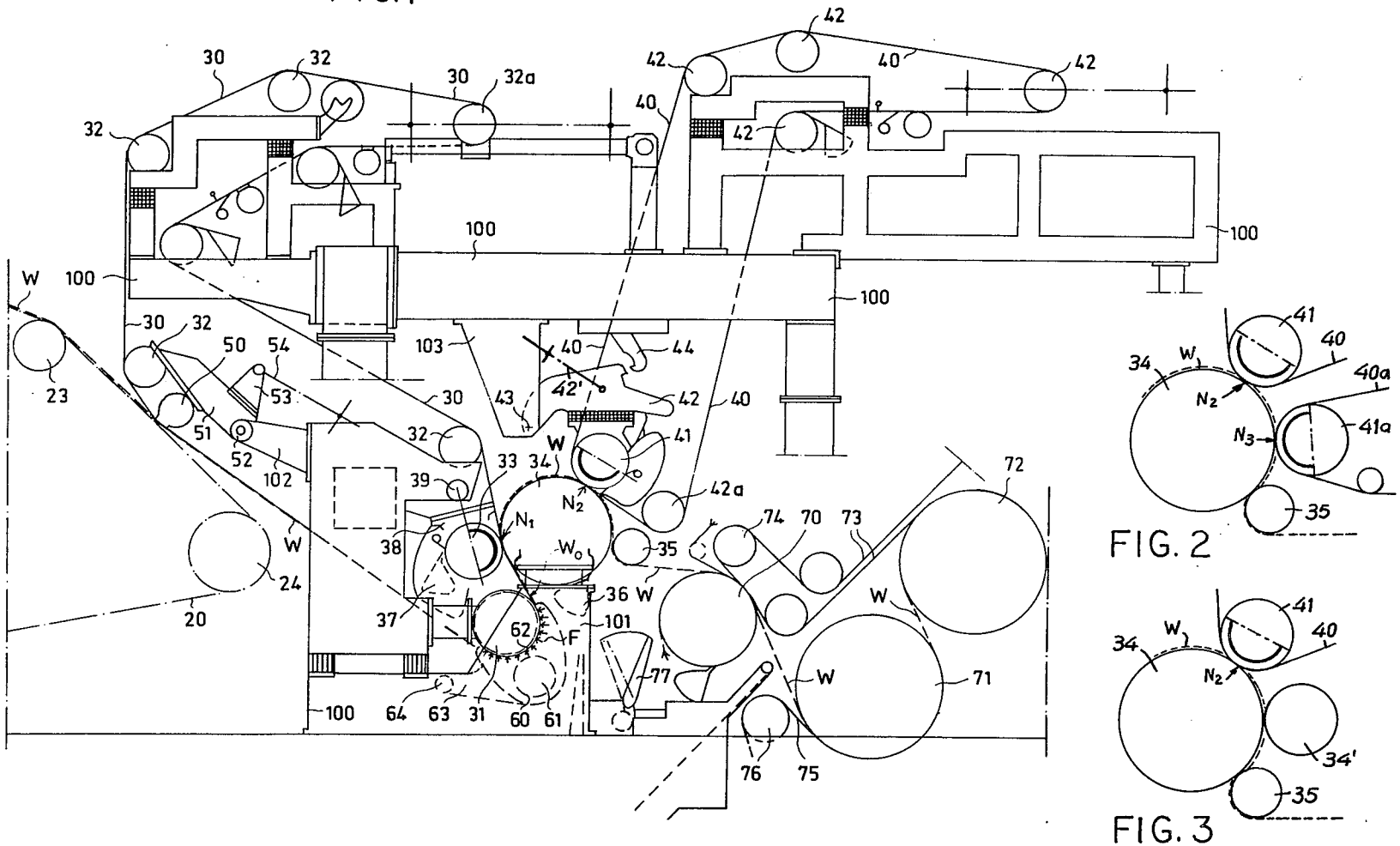
FIG. 1 is a schematic elevation of a paper machine, FIG. 1 showing one end region of a wire former as well as one end region of a drying section, with FIG. 1 showing the structure situated between the latter regions, this structure including the press section of the machine.
FIG. 2 fragmentarily illustrates in a schematic manner another embodiment of a press section which may be utilized according to the method and apparatus of the invention.
FIG. 3 fragmentarily illustrates in a schematic manner a further embodiment of a press section which may be utilized according to the method and apparatus of the present invention.

As is indicated in FIG. 1, a web W has been formed on a wire 20 which may form one of a pair of twin-wires, the wire 20 serving to carry the web W beyond the common path of travel of the pair of wires of the twin-wire former. At the region of the wire 20 illustrated in FIG. 1 the wire 20 is guided by the illustrated guide roll 23 and the illustrated return roll 24. The detachment of the web W from the wire 20 takes place at the part of the wire 20 which travels between the rolls 23 and 24. At the detaching location the web W is transferred to a transfer felt 30 in the form of an endless felt means which forms also the first felt of the press section. For the purpose of transferring the web W to the endless felt means 30, use is made of a transfer suction box 50 which is connected to the suction system so as to create a flow of air travelling through the wire 20 toward and through the endless felt means 30 into the suction box 50. Thus this flow of air will reliably cause the web W to adhere to the endless felt means 30 which contacts the web W at the detaching location illustrated. Thus by way of contacting the web with the endless felt means 30 and creating the suction at the suction box 50 the web is deflected away from the wire 20 and travels with the felt 30 away from the wire 20. The endless felt means 30 forms a closed loop in which are located a plurality of guide rolls 32 which serve to guide the felt 30 along the path illustrated. In addition to the guide rolls 32 there are also provided for the felt 30 a reconditioning means and a washing press which in themselves are known. The upper right guide roll 32*a* is adjustable so as to be capable of adjusting the tension of the endless felt means 30.

The transfer suction box 50 is a component which in itself is known. The machine includes a frame 100 which carries various components, and in connection with the frame 100 the transfer suction box 50 has been mounted, as illustrated on a cantilever beam 102 which is carried by the frame 100. The cantilever beam 102 carries the frame component 51 which is pivoted at 52 to the cantilever beam 102. Thus, there may be a pair of these beams 102 between which the pivot 52 extends and on which the lever 51 which carries the suction box 50 is pivotally mounted. The lever 51 is fixed with arms 53 which are operatively connected with a force means 54 which is schematically illustrated and which may take the form of a hydraulic piston-and-cylinder assembly. This force means 54 is pivotally connected to the frame 100 as well as to the arms 53 so that it is possible by way of the force means 54 to tilt the lever 51 at the pivot 52. In this way it is possible to adjust the operating position of the transfer suction box 50 as well as to displace the latter completely away from its operating position as, for example, when the felt 30 is to be changed.

The transfer felt 30 is at the same time the felt of the first press nip $N_1$ at the press section of the paper machine. Of course the guide rolls 32 guide the endless felt 30 along a predetermined path, and as this felt 30 travels toward the first press nip it first is required to lap through a considerable angle around a roll 31, in accordance with the present invention. This roll 31 is a roll which has a recessed surface in that the outer surface of the roll 31 may be formed with circumferential grooves, a helical groove, or the roll 31 may be formed with perforations which extend to the outer surface thereof. Thus the felt 30 is guided around the grooved and/or perforated roll 31 with the web W adhering to the felt 30 situated between the web and the roll 31, so that in this way the direction of travel of the web W and the felt 30 are substantially reversed at the roll 31. As is apparent from FIG. 1, the angle by which the roll 31 is lapped by the web 30 and the web W is substantial, this angle preferably being on the order of 100°–200°.

In accordance with the method and apparatus of the invention a hot gas is directed toward the web W and through the latter toward the felt 30 as the web and the felt 30 lap the roll 31. Thus, in FIG. 1 there is shown a steam-supply box 60 into which steam which may be superheated to some extent is supplied through the pipe 61. The steam supply box 60 has an upper curved wall which is foraminous and which follows the curvature of the felt 30 and the web W as they lap the roll 31. Thus the illustrated curved wall 62 of the supply box 60 is formed with a multiplicity of openings through which the steam can escape, as illustrated by the arrows F, to be delivered against the web which travels with the felt 30 around the roll 31. The steam passes through the web W as well as the felt 30 into the grooves and/or holes in the roll 31 and releases, as it condenses, its latent heat into the web W and partly also into the felt 30. At the same time, the pressure of the steam in the box 60, this pressure being substantially above atmospheric pressure, urges the web W against the felt 30 so as to prevent the web W, which is still comparatively wet and weak at this stage, from being detached from the felt 30 as a result of the effect of centrifugal force, for example.

It will thus be understood that the steam supply box 60 fulfills two functions. First, the steam supplied thereby serves to heat the web W and possibly also the felt 30 behind the same, for the purpose of enhancing the dewatering action which takes place at the substantially immediately following first press nip $N_1$. In the second place, the steam acts to support the web W as it changes its direction of travel from its detachment from the wire 20 toward the first press nip $N_1$. The enhancing of the dewatering results in the fact that the viscosity of the water is lowered as its temperature is increased.

As is shown schematically in FIG. 1, the steam supply box 60 is carried by arms 63 supported on a pivot 64 carried by the frame 100, so that the position of the steam supply box 60 may be changed as required. Thus the steam supply box 60 may be moved away in conjunction with the roll 31 if required, as when the felt 30 is changed, for example. The roll 31 is preferably a grooved roll having a covering made, for example, of a suitably profiled strip which is wound onto the exterior surface of a drum or shell beneath the wound profiled strip. The cross section of the strip is such that when it is wound onto the roll body the roll 31 will be provided at its exterior with a grooved surface.

The press section of the illustrated machine includes a smooth-surfaced central press roll 34 such as, for example, a stone roll. It is around this roll that the press nips $N_1$ and $N_2$ are situated. It is to be pointed out, however, in this connection that the number of press nips may be more than two such as, for example, three press nips, and such an arrangement is illustrated in FIG. 2. For this purpose the diameter of the central roll 34 shown in FIG. 2 may be somewhat greater than that of the roll shown in FIG. 1, if necessary.

The first press nip $N_1$ is defined by this smoothsurfaced central press roll 34 and the first press roll 33 which has a recessed surface such as a suitably grooved surface of the type referred to above in connection with roll 31. The web W emerges at the location $W_o$ from the roll 31 and travels together with the endless felt means 30 through the first press nip $N_1$. It will be seen that the distance between the location $W_o$ and the first press nip $N_1$ is extremely short so that there is very little opportunity for the web to cool before reaching the first press nip. At this first press nip $N_1$, the web W is detached from the felt 30 and while continuing to be supported by the central roll 34 travels on the surface thereof to the second press nip $N_2$.

As has been indicated, the roll 33 is a recessed surface roll such as a grooved roll, for example, and in the hollow interior of the roll 33 there is a deflection-compensating means which in itself is known. Furthermore, as is schematically illustrated, a doctor blade 37 is provided to maintain the surface of the roll 33 clean. This roll 33 is carried by a frame part 38 which in turn is connected by a pivot 39 to the main frame structure 100 of the machine. By way of this structure it is possible to adjust the line of pressure at the press nip $N_1$ as well as to move the press roll 33 away from its position illustrated such as, for example, for the purpose of changing the felt 30. Thus an unillustrated hydraulic cylinder and piston assembly, similar to the assembly 54 is operatively connected between the frame 100 and the turnable part 38 for adjusting the pressure and displacing roll 33 as required.

Thus, as is apparent from the above, the web W travels from the forming wire 20 onto the felt 30 and thereafter, while supported at all times by the felt 30, the web W is subjected first to a heat treatment at the steam-supply box 60 which furthermore contributes to supporting the web as it changes direction, as pointed out above, and then the web continues to travel with the felt 30 to the first press nip $N_1$ where the web W is detached from the felt 30 only after the web W has positively adhered to the surface of the smooth central roll 34.

The second press nip $N_2$ of the press section is defined by this smooth-surfaced central roll 34 and the roll 41 which also has a grooved surface. This nip $N_2$ includes also its own endless felt 40 which is guided by the guide rolls 42 as illustrated. The guide roll **42*a* is situated at the lower right portion of the endless felt 40 determines the detachment angle between the felt 40 and the web W. Thus the web W still adheres to the surface of the roll 34 when travelling beyond the second press nip $N_2$ while the felt 40 travels beyond the press nip $N_2$ away from the roll 34** in the manner illustrated.

Thus, subsequent to the second press nip $N_2$, the web continues to be supported by and to travel with the smoothsurfaced central roll 34, from which the web is detached by way of the roll 35 which serves to direct the web to the drying means or drying section of the paper machine. The roll 35 which is used to detach the web from the roll 34 may, for example, be a suction transfer roll which in itself is of a known construction.

It is apparent, therefore, that from the moment the web is detached from the forming wire 20 until it reaches the detaching roll 35 the web is continuously supported so that there are no free draws of the web between the wire 20 and the roll 35. When the web reaches the roll 35 this web is of course of sufficient strength and has had sufficient dewatering to reliably support itself while travelling to the drying section through the relatively short distance indicated in FIG. 1.

With respect to the press roll 41 which participates in the formation of the second press nip $N_2$, this roll also is a recessed surface roll, preferably a grooved roll in which the grooves are formed by way of winding onto the roll body a strip having a suitable cross-sectional configuration. This roll 41 also is hollow and is provided in its interior with a known deflection-compensating means. The roll 41 is carried by a turnable frame part **42*b* which is pivoted at 43 to cantilever beams 103 which are fixedly carried by the main frame 100. Between the beams 103 and the swingable support 42*b* there is a force means 42' in the form of a suitable hydraulic cylinder and piston assembly, as schematically illustrated, so that by the operation of this force means 42' it is possible to adjust the pressure at the second nip $N_2$ as well as to displace the roll 41 away from the roll 34 for the purpose of changing the felt 40. In order to maintain the roll 41 releasably in its position displaced away from the roll 34, a releasable hook means 44 is provided as schematically illustrated to cooperate with the swingable support 42**.

The central press roll 34 has an exposed downwardly directed surface region with which a doctor blade 36 cooperates so as to maintain the outer surface of the roll 34 clean. This free exposed surface region of the roll 34 is important for the reason that waste paper may escape in this way into a save-all which is situated below the roll 34. The waste material separated from the surface of the roll 34 by the doctor blade 36 is guided by an adjustable waste guide baffle 77 which is schematically illustrated.

It is therefore apparent from the above that by way of the present invention an extremely compact press section is achieved wherein the web W travels without any open draw in fully closed conduction at all times. A further advantage of the illustrated structure resides in the fact that it is possible to situate around the central roll 34 which has a diameter larger than the other rolls the necessary number of press nips, so that even more than the illustrated two press nips of FIG. 1 can be accommodated. It is thus possible to provide three or even four press nips if desired, and in fact these arrangements may be provided in such a way that it is easy to bring about changing of rolls and felts. Furthermore it is to be noted that the press section requires no suction rolls.

In connection with the provision of additional nips, reference may be made to FIG. 2, where there is illustrated a further press roll 41a which may be identical with the roll 41 and which forms with the roll 34 the third press nip $N_3$ which is illustrated in FIG. 2. In addition it will be seen that this press nip $N_3$ has its own endless felt 40a which is fragmentarily illustrated in a schematic manner. As was pointed out above, if necessary the roll 34 of FIG. 2 may have a diameter somewhat greater than that of the roll 34 of FIG. 1.

The drying means or drying section of the machine includes the drying cylinders 71 and 72. Only one of the several drying cylinders 71 is illustrated. It will be understood that additional cylinders 71 are arranged in a row at the same elevation as the illustrated cylinders 71. The drying cylinders 72 are arranged in a row above the cylinders 71 with the cylinders 72 staggered with respect to the cylinders 71 so that the cylinders 72 are aligned with the gaps between the cylinders 71 as is well known. The web W is fed to the drying cylinders by way of a so-called lead-in cylinder 70. The schematically and fragmentarily illustrated upper felt 73 cooperates in a known way with the upper cylinders 72, the upper felt 73 being guided by guide rolls 74 some of which are illustrated. A lower felt 75 cooperates in a known way with the lower cylinders and is guided by guide rolls 76 one of which is illustrated.

As has been pointed out above, the press rolls 33 and 41, as well as any additional press rolls, such as the press roll 41a of FIG. 2, are most appropriately rolls with grooved surfaces and which have in their interiors deflection-compensating means which are known so that the details thereof are not illustrated. It should furthermore be noted that the smoothsurfaced central roll 34, which is for example a granite roll, has a diameter considerably larger than other press rolls, such as a diameter on the order of, for example 1.5–3 times the diameter of the smaller press rolls. As a result, the central press roll 34 undergoes virtually no deflection at all. This fact also contributes to the fact that the press nips $N_1$, $N_2$ and any additional press nips impose on the central roll loads which are opposed to each other in that they act in opposite directions and tend to cancel each other. In other words in FIG. 1, for example, the pressure of the press roll 41 against the roll 34 is substantially opposed to the pressure of the press roll 33 against the roll 34, so that these loads tend to cancel each other.

As has been indicated above, a number of press nips can be accommodated around the central roll 34. In addition, other rolls may be provided in conjunction with the central roll 34, such as smoothing rolls, in which case such a smoothing roll has no felt and defines a smoothing press action together with the central roll 34. Thus, as may be seen from FIG. 3, subsequent to the press roll 41 of the second press nip $N_2$, there is a further smooth-surfaced roll 34' which acts without any felt against the web W before the latter reaches the roll 35, to achieve in this way a smoothing action on the web.

Of course, the invention is not to be narrowly confined to the above details which are presented only by way of example, inasmuch as these details may vary within the scope of the inventive concept defined by the claims which follow.

What is claimed is:

1. A method in a paper making machine for detaching a paper web from a forming wire and conducting the web over a closed draw to the press section of the machine such that the web only laps non-suction rolls and for carrying out a dewatering pressing operation, comprising the steps of:

transferring the web from a forming wire onto a felt;

conducting the web carrying felt over a substantial sector of a non-suction guide roll prior to passing the web carrying felt through the first press nip in the press section of the machine defined by a first press roll and a smooth surface roll;

simultaneously directing a steam treatment onto the portion of the web which laps said non-suction guide roll such that the web is heated, said steam treatment acting to support said web on said felt; and directing said web carrying felt from said non-suction guide roll through the first press nip of the press section.

2. A method as recited in claim 1 wherein said step of transferring the web from a forming wire onto a felt includes, conducting the web on the forming wire; conducting said felt over the suction slit of a stationary suction box, conducting the web carrying wire onto said felt such that the web contacts said felt in the vicinity of said suction slit whereby a suction effect is directed onto the web and the web is transferred onto said felt, and deflecting the path of said web carrying felt with respect to said wire.

3. In a method as recited in claim 1 and including the step of continuing the travel of the web along said smoothsurfaced roll beyond said first press nip while detaching the web from the felt immediately subsequent to said first press nip.

4. In a method as recited in claim 3 and including the step of providing for the web at said smooth-surfaced roll a second press nip while compressing the web at said second press nip between said smooth-surfaced roll and a second press roll which has a recessed surface and a second felt which laps said second press roll and travels with said web through said second press nip.

5. In a method as recited in claim 4 and including the step of continuing the travel of the web beyond said second press nip while still supporting said web at said smoothsurfaced roll and while said second felt travels away from the web beyond said second press nip, and providing for the web beyond said second press nip a third press nip between said smooth-surfaced roll and a third press roll having also a recessed surface and while lapping said third press roll with a third felt which travels through said third press nip with said web.

6. In a method as recited in claim 4 and including the step of continuing the travel of the web beyond the second press nip along said smooth-surfaced roll to be supported by the latter while the second felt travels away from the web beyond said second press nip, and engaging the web with a smoothing roll in the form of a second smooth-surfaced roll which has no felt and which presses the web between both of said smooth-surfaced rolls.

7. In a method as recited in claim 1 and including the step of engaging the smooth-surfaced roll with a doctor blade at a location where the surface of the smooth-surfaced roll is exposed, and guiding waste away from said smooth-surfaced roll after the waste has been separated therefrom by the doctor blade.

8. Apparatus in a paper making machine for detaching a paper web from a forming wire and conducting the web over a closed draw to the press section of the machine such that the web only laps non-suction rolls and for carrying out a dewatering pressing operation, comprising:

a press section including a central press roll and a first press roll, said central and first press rolls defining a first press nip;

means for transferring a web from a forming wire onto an endless felt, said endless felt defining a closed loop;

guide roll means situated at least in part within said closed loop for guiding said endless felt, said guide roll means including a non-suction guide roll having an outer surface spaced from said first press nip, said web carrying felt adapted to lap said guide roll over a substantial sector thereof and then pass through said first press nip; and means for directing a steam treatment onto a portion of the web which laps said guide roll such that the web is heated, said steam treatment acting to support said web on said felt.

9. Apparatus as recited in claim 8 wherein said guide roll has a recessed surface.

10. Apparatus as recited in claim 8 wherein said guide roll has a foraminous shell.

11. Apparatus as recited in claim 8 wherein said steam treatment means includes means for directing steam onto said lapping web portion in a substantially radial direction with respect to said guide roll.

12. Apparatus as recited in claim 8 wherein said means for transferring said web from said forming wire to said endless felt comprisees a stationary suction box situated within said closed felt loop and applying suction therethrough, said forming wire having a portion which runs adjacent to said suction box whereby said suction detaches the web from said forming wire.

13. The combination of claim 8 and wherein a drying means is situated adjacent the press section, and a second guide roll situated adjacent said smooth-surfaced press roll for guiding the web from the latter to said drying means, said central press roll supporting the web until it is directed by said second guide roll to the drying section so that until the web is directed to the drying section away from the central press roll the web is fully supported at all times without having any open draw all the way from the detachment of the web from the forming wire means until the web travels beyond the central press roll toward the drying means.

14. The combination of claim 13 and wherein at least one additional press roll and felt cooperating therewith are provided at said central press roll to provide for the web a second press nip before reaching said drying means.

15. The combination of claim 14 and wherein beyond said second press nip there is an additional press roll and felt providing for a third press nip prior to detachment of the web from the central press roll to travel to said drying means.

16. The combination of claim 14 and wherein beyond said second press nip a smooth-surfaced press roll without a felt urges the web against the central press roll to provide for smoothing of the web prior to travel thereof to said drying means.

17. The combination of claim 14 and wherein said central smooth-surfaced press roll has a downwardly directed exposed surface, doctor blade means engaging the latter surface of said central press roll, and guide means situated beneath the surface of the press roll acted on by said doctor means for guiding waste away from the smooth-surfaced press roll.

* * * * *